US012330207B2

(12) United States Patent
Heep et al.

(10) Patent No.: US 12,330,207 B2
(45) Date of Patent: Jun. 17, 2025

(54) JAW ASSEMBLY FOR A RIVET SETTING TOOL

(71) Applicant: BLACK & DECKER INC., New Britain, CT (US)

(72) Inventors: Tobias Heep, Idstein (DE); Luca Bardaré, Idstein (DE); Kevin Bhikadiya, Idstein (DE); Yasar Akbaba, Idstein (DE); Philipp Libera, Taunusstein Wehen (DE); Benjamin Schmidt, Idstein (DE)

(73) Assignee: BLACK & DECKER INC., New Britain, CT (US)

( * ) Notice: Subject to any disclaimer, the term of this patent is extended or adjusted under 35 U.S.C. 154(b) by 134 days.

(21) Appl. No.: 18/191,658

(22) Filed: Mar. 28, 2023

(65) Prior Publication Data

US 2024/0033808 A1 Feb. 1, 2024

(30) Foreign Application Priority Data

Jul. 27, 2022 (GB) ..... 2210945

(51) Int. Cl.

| | |
|---|---|
| ***B21J 15/00*** | (2006.01) |
| ***B21J 15/02*** | (2006.01) |
| ***B21J 15/04*** | (2006.01) |
| ***B21J 15/26*** | (2006.01) |
| ***B21J 15/32*** | (2006.01) |
| ***B21J 15/36*** | (2006.01) |

(52) U.S. Cl.

CPC ..... *B21J 15/043* (2013.01); *B21J 15/027* (2013.01); *B21J 15/26* (2013.01); *B21J 15/326* (2013.01); *B21J 15/365* (2013.01)

(58) Field of Classification Search

CPC ..... B21J 15/043; B21J 15/027; B21J 15/26; B21J 15/326; B21J 15/365; B21J 15/105

See application file for complete search history.

(56) References Cited

U.S. PATENT DOCUMENTS 809,296 A * 1/1906 Gordon ..... B23B 31/1253 279/65
2,473,913 A * 6/1949 Shaff ..... B21J 15/043 72/114

(Continued)

FOREIGN PATENT DOCUMENTS

| | | |
|---|---|---|
| CN | 102527907 B | 11/2013 |
| EP | 0834371 A1 | 4/1998 |
| JP | 2022504247 A | 1/2022 |

OTHER PUBLICATIONS

EP Search Report Dated Dec. 15, 2023 cited in corresponding EP Patent Application No. 23161060.1.

(Continued)

*Primary Examiner* — Lee A Holly
(74) *Attorney, Agent, or Firm* — Kofi A. Schulterbrandt

(57) ABSTRACT

A jaw assembly for a rivet setting tool the jaw assembly including a plurality of jaws each jaw defining part of an interlocking mechanism and an oppositely located part of another interlocking mechanism wherein adjacent jaws interlock via engagement of the parts of the interlocking mechanisms of the respective jaws for enabling radial movement of the jaws relative to each other while restricting axial movement of the jaws relative to each other.

19 Claims, 5 Drawing Sheets

(56) References Cited

U.S. PATENT DOCUMENTS

| | | | | |
|---|---|---|---|---|
| 2,654,611 | A * | 10/1953 | Lee | B23B 31/1253 279/56 |
| 3,406,557 | A | 10/1968 | Harris | |
| 3,467,403 | A | 9/1969 | Coyle et al. | |
| 4,088,333 | A | 5/1978 | Nobile et al. | |
| 4,598,572 | A | 7/1986 | Mondello et al. | |
| 6,182,345 | B1 | 2/2001 | Travis | |
| 11,292,050 | B1 | 4/2022 | Spilker | |
| 2021/0299738 | A1 | 9/2021 | Hsueh et al. | |
| 2023/0339026 | A1 | 10/2023 | Childers et al. | |

OTHER PUBLICATIONS

GB Search Report Dated Jan. 24, 2023 cited in corresponding GB Patent Application No. 2210945.8.

* cited by examiner

JAW ASSEMBLY FOR A RIVET SETTING TOOL

CROSS-REFERENCE TO RELATED APPLICATIONS

This application claims priority from GB Patent Application No. 2210945.8, filed Jul. 27, 2022, the disclosures of which is incorporated herein by reference in its entirety.

FIELD OF THE INVENTION

This document relates to the jaws of a rivet setting tool.

BACKGROUND OF THE INVENTION

Blind rivet setting tools have a jaw assembly for gripping and pulling the mandrel of a blind rivet as described in GB10004361 and US2019/0247913A1. The jaw assembly of a blind rivet setting tool may be replaced during routine maintenance due to wearing of the jaws. Alternatively, since blind rivets come in different shapes and sizes, the jaw assembly of a blind rivet setting tool may be replaced to accommodate different varieties of blind rivets. During reassembly of a blind rivet setting tool it is important that the jaws are aligned correctly in order to effectively set blind rivets.

BRIEF SUMMARY OF THE INVENTION

According to an aspect of the invention there is a jaw assembly for a rivet setting tool the jaw assembly comprising a plurality of jaws each jaw defining part of an interlocking mechanism and an oppositely located part of another interlocking mechanism wherein adjacent jaws interlock via engagement of the parts of the interlocking mechanisms of the respective jaws for enabling radial movement of the jaws relative to each other while restricting axial movement of the jaws relative to each other.

Each said jaw may define at least one male part of a said interlocking mechanism and an oppositely located at least one female part of another said interlocking mechanism.

Each said jaw may define at least one male part and at least one female part of a said interlocking mechanism and an oppositely located at least one female part and at least one male part of another said interlocking mechanism.

The at least one male part of a said interlocking mechanism may be a projection and the at least one female part of a said interlocking mechanism may be a recess.

Each of the jaws may have a single projection and a single recess.

The projection and the recess of each said jaw may be positioned mid-way between first and second ends of the jaws.

Each of the jaws may comprise gripping teeth for gripping a mandrel of a blind rivet in use wherein a width of the gripping teeth may be narrower between the projections and recesses.

The jaw assembly may comprise a first jaw, a second jaw and a third jaw which are identically shaped.

The jaw assembly may have a first jaw and a second jaw and wherein the first jaw may be provided with a first male part of a first interlocking mechanism and an oppositely located male part of a second interlocking mechanism whereas the second jaw may be provided with a female part of the first interlocking mechanism and an oppositely located female part of the second interlocking mechanism.

The male parts of the interlocking mechanisms may be projections and the female parts of the interlocking mechanisms may be recesses.

The jaw assembly may comprise a retainer for biasing the jaws radially towards each other, wherein the retainer may be an o-ring, a c-clip, an elastic ring or a spring fastener. Each said jaw may comprise a groove configured to receive the retainer.

According to another aspect of the invention there is a rivet setting tool comprising a jaw assembly according to any variation heretofore described, wherein the tool may be a blind rivet setting tool.

BRIEF DESCRIPTION OF THE DRAWINGS

Various aspects and embodiments of the invention will now be described by way of non-limiting example with reference to the accompanying drawings, in which.

DETAILED DESCRIPTION OF THE PREFERRED EMBODIMENT

Figure 1:
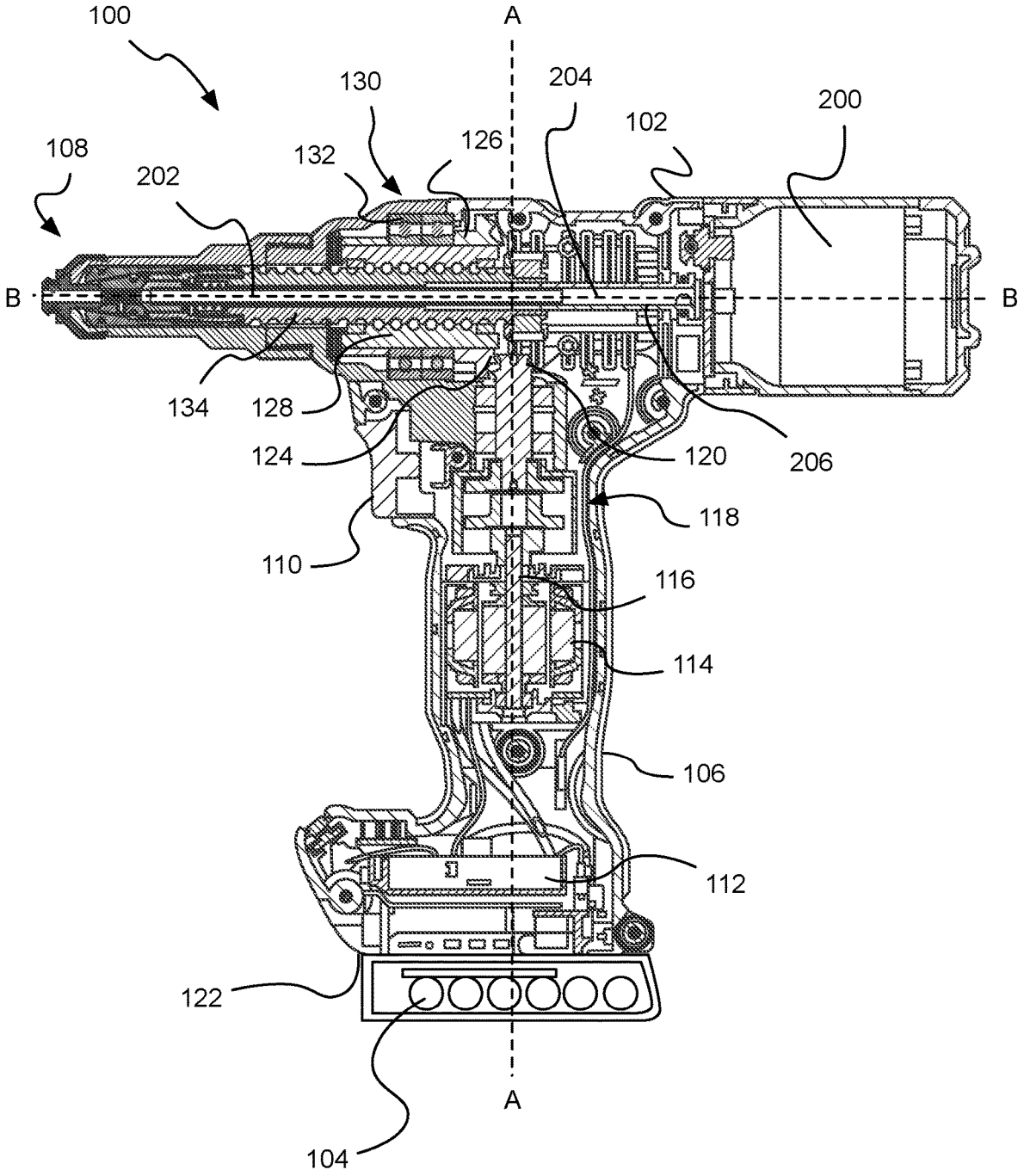
FIG. 1 shows a side cross-sectional view of a blind rivet setting tool.

FIG. 1 shows a side cross-sectional view of a blind rivet setting tool 100. The tool 100 has a housing 102 of a clam shell type construction having two halves which are fastened together. A battery 104 is releasably connected to the base 122 of the handle 106 via a battery attachment feature. To use the tool 100 a user inserts the mandrel of a blind rivet into a nose 108 of the tool 100 and pulls a trigger 110. In response to a controller 112 of the tool determining that the trigger 110 has been pulled the controller 112 generates a signal to activate a motor 114, which is a brushless motor. The motor 114 is located in the handle 106 and has a motor output shaft 116. Torque from the motor output shaft 116 is transferred via a transmission 118 to a first bevel gear 120. The transmission 118 comprises a series of planetary gear arrangements for reducing output speed while increasing torque. The first bevel gear 120 rotates at a lower speed than the motor output shaft 116 however with an increased torque relative to the motor output shaft 116. The motor output shaft 116, transmission 118 and first bevel gear 120 are aligned along a first axis A-A which extends along a longitudinal length of the handle 106. By also locating the battery 104 on the first longitudinal axis A-A weight distribution of the tool 100 is improved.

A second bevel gear 124 is provided on the end face of a driving sleeve 126. The driving sleeve 126 is rotationally fixed relative to an input sleeve 128 of a ball screw arrangement 130. The driving sleeve 126 and input sleeve 128 are fixed relative to each other due to a friction fit arrangement. An internal surface of the input sleeve 128 comprises a threaded surface. The outer surface of the driving sleeve 126 is supported by bearings 132 which enable rotation of the driving sleeve 126, and thereby the input sleeve 128, with respect to the housing 102. A threaded rod 134 is mounted within the input sleeve 128 and extends through the input sleeve 128. A plurality of balls, such as metal ball bearings, ride in the opposing threaded surfaces of the input sleeve 128 and threaded rod 134, thereby defining a ball screw arrangement 130.

When the input sleeve 128 is rotatably driven by the driving sleeve 126 this causes axial movement of the threaded rod 134. In other words, torque from the motor 114 is transferred through the transmission 118, first and second bevel gears 120, 124 and driving sleeve 126 to the input sleeve 128, whereby rotation thereof causes axial movement of the threaded rod 134. The threaded rod 134 is restricted from rotating and is configured to move along a second longitudinal axis B-B of the tool 100 upon rotation of the input sleeve 128. The threaded rod 134 can move forwards or backwards along the axis B-B depending on the motor driving direction.

Figure 2:
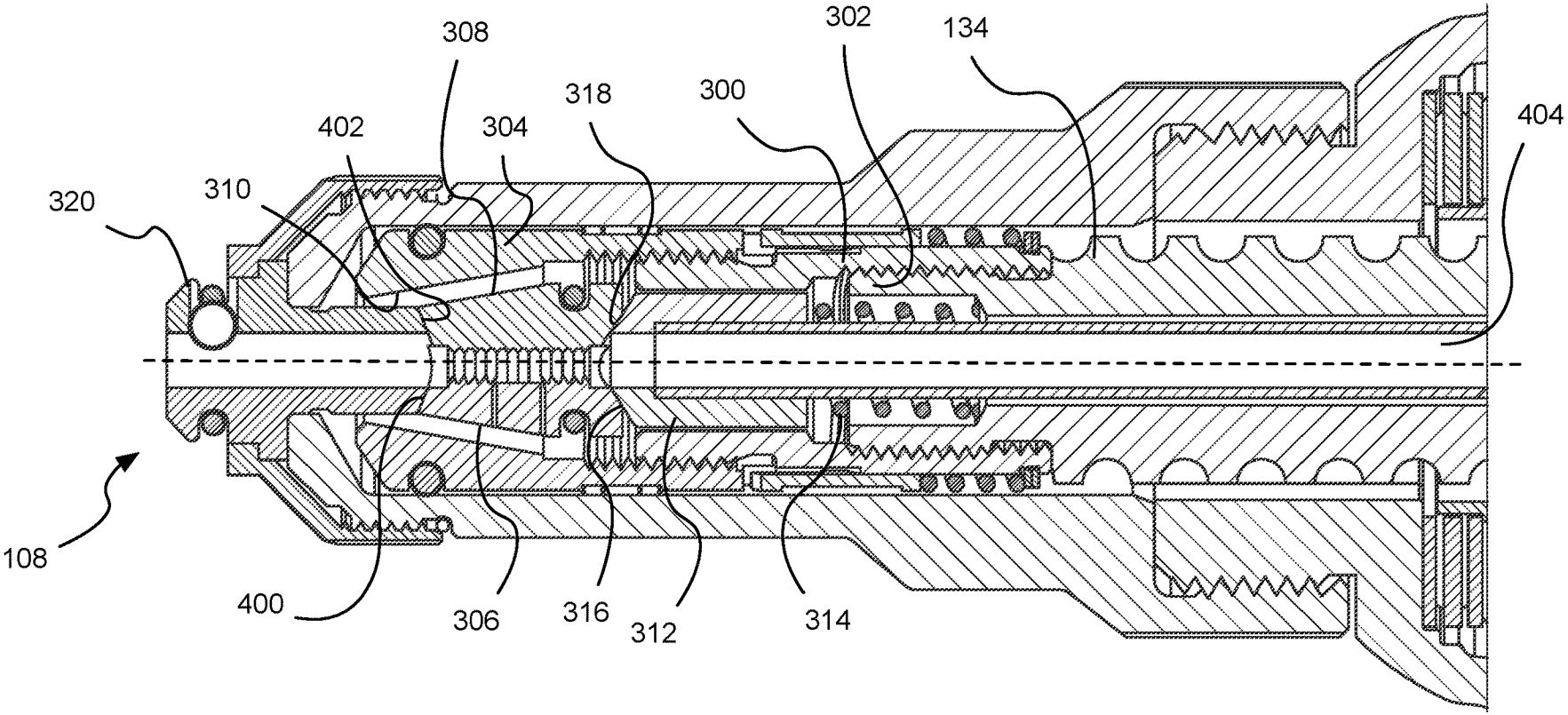
FIG. 2 shows a close-up of part of the blind rivet setting tool in FIG. 1.

Referring to FIG. 2 a connecting sleeve 300 is attached to a first end 302 of the threaded rod 134, which is mounted to the threaded rod 134 via a screw thread. A pull-back hull 304 is threadably attached to the connecting sleeve 300. Axial movement of the threaded rod 134 along the second longitudinal axis B-B therefore also causes axial movement of the pull-back hull 304.

A jaw assembly 500 is located within the pull-back hull 304. The jaw assembly (shown in FIG. 3*a*) has a plurality of circumferentially arranged jaws 306 each of which has a ramped outer surface 308 for cooperating with a conical inner surface 310 of the pull-back hull 304. A separator sleeve 312 is forced by a spring 314 against the jaws 306; more specifically a ramped front surface 316 of the separator sleeve 312 is forced against ramped rear surfaces 318 of the jaws 306. A nosepiece 320 is releasably attached at the opening to the nose 108 of the tool 100 which has an annular ramped surface 402. Each of the jaws 306 have a front ramped surface 400 for cooperating with the annular ramped surface 402 of the nose piece 320. Cooperation between the ramped outer surfaces 308 of the jaws 306 and the conical inner surface 310 of the pull-back hull 304, between the ramped rear surfaces 318 of the jaws 306 and the ramped front surface 316 of the separator sleeve 312 and between the front ramped surfaces 400 of the jaws 306 and the annular ramped surface 402 of the nose piece 320 enables the tool 100 to set blind rivets in use.

In a home position the heretofore described tool features occupy a position in which cooperation between the ramped rear surfaces 318 of the jaws 306 and the ramped front surface 316 of the separator sleeve 312 and between the front ramped surfaces 400 of the jaws 306 and the annular ramped surface 402 of the nose piece 320 provides that the jaws 306 are held radially apart from each other (see FIG. 3*b*), which enables the mandrel of a rivet to be inserted through the nosepiece 320 and through the space between the jaws 306. To set a blind rivet a mandrel thereof is inserted through the nose piece 320 such that the mandrel extends between the jaws 306. Upon pulling the trigger 110 of the tool 100 the controller 112 causes the threaded rod 134, and thus the pull-back hull 304, to move along the second longitudinal axis B-B to the right in FIGS. 1 and 2. As the pull-back hull 304 is retracted its conical inner surface 310 is forced against the outer surfaces 308 of the jaws 306, whereby a component of force draws the jaws 306 backwards with the pull-back hull 304 whereas another component of force urges the jaws 306 radially inwards thereby clamping the mandrel of the blind rivet being set between the jaws 306.

In other words, pulling the pull-back hull 304 to the right in FIGS. 1 and 2 causes the jaws 306 to grip and pull the mandrel of a rivet being set. The blind rivet thus is pulled against the nose piece 320 for deforming the blind rivet and when the mandrel of the blind rivet is pulled far enough for setting the blind rivet the mandrel snaps.

Subsequently the tool 100 is required to perform a reset operation to dispose of the broken mandrel and to accept a fresh blind rivet for setting. During a reset operation of the tool 100 the controller 112 causes the motor 114 to reverse its direction for moving the threaded rod 134, and thus the pull-back hull 304, in the other direction along the second longitudinal axis B-B to the left in FIGS. 1 and 2. When the pull-back hull 304 has been moved sufficiently far to the left the spring 314 via the separator sleeve 312 will urge the front ramped surfaces 400 of the jaws 306 against the annular ramped surface 402 of the nose piece 320. Further movement of the threaded rod 134 to the left in FIGS. 1 and 2 will increase the pressure of the spring 314 against the separator sleeve 312 and thus cause the front ramped surfaces 400 of the jaws 306 to ride along the annular ramped surface 402 of the nose piece 320 while the ramped rear surfaces 318 of the jaws 306 ride along the ramped front surface 316 of the separator sleeve 312. This causes the jaws 306 to move radially outwards and release the grip on the snapped mandrel, whereby with reference to FIG. 1 the released snapped mandrel can be caused to fall under gravity along an internal path in the direction of a collection chamber 200. For example, after a rivet setting operation, the user tilts the tool 100 such that the snapped mandrel moves into the collection chamber 200. The internal path is defined by aligned openings extending through components between the jaws 306 and the collection chamber 200, including a first channel 202 extending through the threaded rod 134 along the second longitudinal axis B-B and a second channel 204 through a guidance sleeve 206.

Figure 3A:
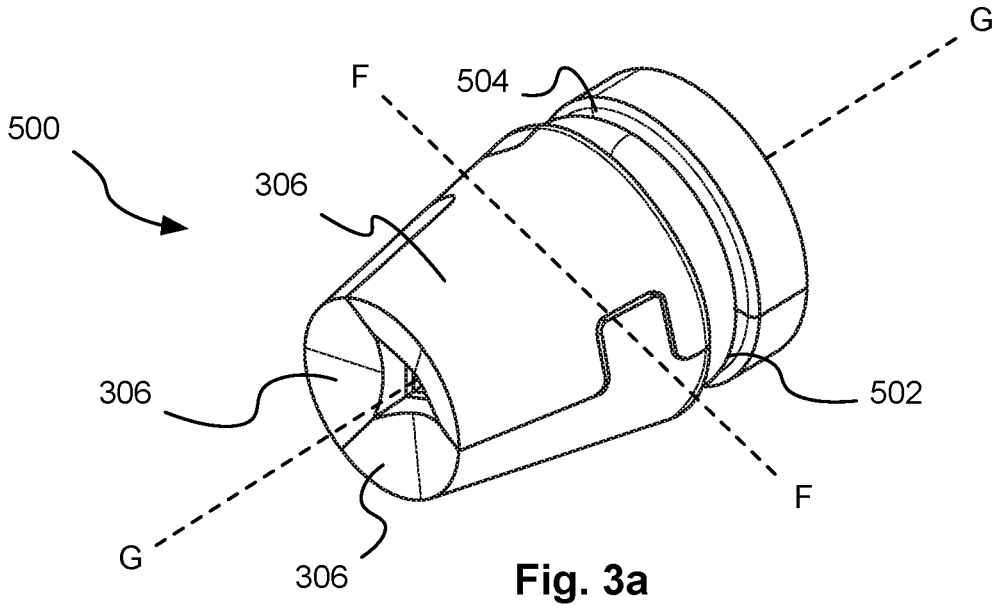
FIGS. 3*a* and 3*b* show a first jaw assembly for a blind rivet setting tool in first and second configurations respectively.
Figure 3B:
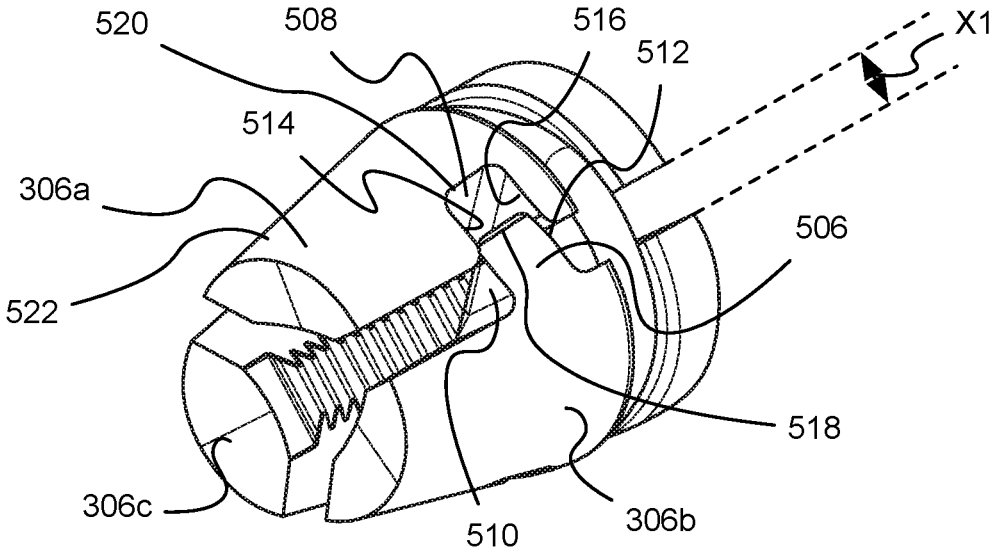

Turning to FIGS. 3*a* and 3*b* the jaw assembly 500 will now be discussed in more detail. FIG. 3*a* shows a perspective view of the jaw assembly 500 in a first configuration in which the jaws 306 are located radially as close to each other as possible. FIG. 3*b* shows a perspective view of the jaw assembly 500 in a second configuration in which the jaws 306 are urged radially apart from each other such as by the jaws 306 being forced against the annular ramped surface 402 of the nose piece 320. The jaw assembly 500 comprises three identical jaws 306 circumferentially arranged about a jaw assembly axis G-G. When the jaw assembly 500 is mounted in the tool 100, the jaw assembly axis G-G is coaxial with the second longitudinal axis B-B of the tool 100. The three jaws 306 can move radially with respect to the jaw assembly axis G-G.

There are situations during which the jaw assembly 500 is removed from the tool, in particular during routine maintenance of the tool 100 during which it is disassembled and then reassembled after being cleaned. Alternatively, the jaw assembly 500 may be swapped with a new jaw assembly because the jaws 306 of the original jaw assembly have worn. Further alternatively the jaw assembly 500 may be swapped with a new jaw assembly because the different jaw assemblies are configured for use with different sized mandrels. Furthermore, some rivets have a profile on the mandrel such as ribs and the jaws intended for use with such rivets have a profile which is configured to mate with the profile on a mandrel for increasing grip. Referring again to FIGS. 3*a* and 3*b* the jaw assembly 500 has a flexible o-ring 502 for holding the jaws 306 of the jaw assembly 500 together when it is not located within the tool 100. Each of the jaws 306 defines part of an annual groove 504 when the jaws 306 are in the configuration shown in FIG. 3*a* wherein the o-ring 502 is located in the annual groove 504 and biases the jaws 306 together. The o-ring 502 can be made from an elastic material such as rubber.

If the jaws 306 of a jaw assembly 500 are axially moveable with respect to each other in use then this causes wear of the o-ring 502, which means that the o-ring can prematurely fail and the jaws can become misaligned so the tool 100 is more likely to jam or not set a blind rivet correctly.

In order to address this problem axial movement of the jaws 306 of the jaw assembly 500 in FIGS. 3*a* and 3*b* is prevented by configuring the jaws such that adjacent jaws can interlock with one another whereby the interlocking features of adjacent jaws guide radial movement of the jaws and restrict axial movement of adjacent jaws relative to each other. A first side of each jaw 306 defines a male part of a two-part interlock or two-part interlocking mechanism and the second side of each jaw 306 defines a female part of the two-part interlock or two-part interlocking mechanism. As can be seen from FIGS. 3*a* and 3*b* said male and female parts of adjacent jaws 306 interlock with each other in the jaw assembly 500.

As shown in FIG. 3*b* the first jaw 306*a* comprises a recess 508 which receives a projection 506 of the second jaw 306*b*. The projection 506 on the other side of the first jaw 306*a* and the recess 508 on the other side of the second jaw 306*b*, and corresponding features of the third jaw 306*c*, are obscured from view in FIG. 3*b*.

Each recess 508 defines a channel in a jaw body which compliments the shape of the adjacent projection 506. The projections 506 each comprise a substantially rectangular cross-sectional shape at their outer edge as shown in FIG. 3*b*. The recesses 508 thus comprise a similar rectangular cross-sectional shape at their respective edges. Since the outer surface of the jaw assembly 500 in the configuration in FIG. 3*a* defines the shape of a truncated cone it will be appreciated the projections 506 and the recesses 508 of the jaw assembly 500 do not comprise a uniform cross-sectional shape.

The interaction between opposing jaws 306 of the jaw assembly 500 will now be discussed in more detail. Cooperation between interlocking projections 506 and recesses 508 prevents relative movement between the jaws 306 along the jaw assembly axis G-G while permitting radial movement of the jaws 306 relative to each other. Referring again to FIG. 3*b* the projections 506 each comprise a first engagement surface 510 and a second engagement surface 512 which are configured to engage reciprocal first and second engagement surfaces 514, 516 on an opposing recess 508.

If a jaw such as the second jaw 306*b* experiences a force urging the jaw to move towards the retracted position with respect to the adjacent jaw such as the first jaw 306*a* then the second engagement surface 512 will engage the second reciprocal engagement surface 516, which will prevent relative axial movement between such jaws. Similarly, if a jaw such as the second jaw 306*b* experiences a force urging the jaw to move in the opposite direction with respect to an adjacent jaw such as the first jaw 306*a* then the first engagement surface 510 will engage the first reciprocal engagement surface 514, which will prevent relative axial movement between such jaws.

When the jaw assembly 500 is in the first configuration shown in FIG. 3*a* the projections 506 of the jaws 306*a*, 306*b*, 306*c* are fully inserted into the recesses 508 of adjacent jaws. In this configuration an end surface 518 of each projection 506 abuts a bottom surface 520 of the recesses 508 in which the projections 506 are received. This means that the projections 506 and recesses 508 can be used to limit the extent to which the jaws 306 can be moved radially towards each other by changing the length of the projections 506 or the depth of the recesses 508.

In use when a mandrel has been inserted between the jaws 306 of the jaw assembly 500 the projections 506 are partially inserted in the corresponding recesses 508 as shown in FIG. 3*b*. This means that the projections 506 and the recesses 508 still prevent the relative axial movement of the jaws 306*a*, 306*b*, 306*c* with respect to each other even when a mandrel of a blind rivet extends through the jaw assembly 500.

The height, width, length and cross-sectional profile of the projections 506 and recesses 508 of the jaw assembly 500 can be varied, provided that the jaws 306 each still define a ramped outer surface 308 for cooperating with a conical inner surface 310 of the pull-back hull 304. Such variations can affect the extent to which the projections 506 extend into the recesses 508 for example as already mentioned, thereby enabling a manufacturer to selectively choose the extent to which the jaws 306 of the jaw assembly 500 can be radially moved towards each other. Furthermore variations in the shape, size and orientation of the projections 506 and the recesses 508 can affect the strength of the respective jaws 306, wherein jaws 306 made of strong metal can have thinner parts than jaws 306 made of less strong metal however presumably stronger metal is more expensive than less strong metal and so a manufacturer can make jaws having a jaw profile based on a balance between material costs and the minimum size and thickness of jaw features permitted by the available material.

Figure 4A:
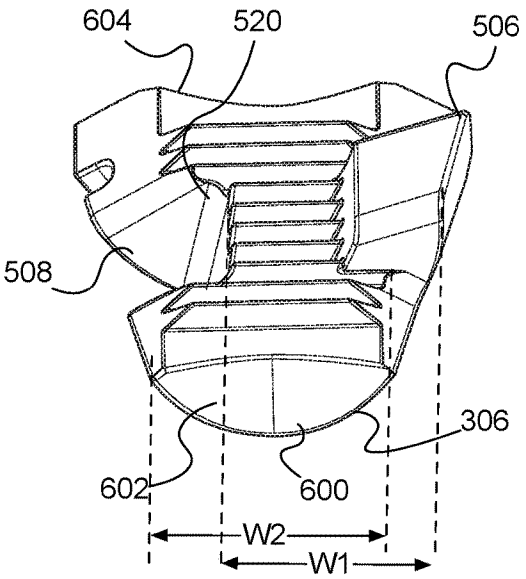
FIGS. 4*a* to 4*c* show a jaw of the first jaw assembly from different angles.

Referring to FIGS. 3*a* and 4*a* the first jaw assembly 500 has a frustoconical shape when in the first configuration in which the jaws 306 are radially as close to each other as they can be and in which the projections 506 of the jaws interlock with corresponding recesses 508 of the jaws 306. The outer surface of a jaw such as the first jaw 306*a* is thus part of the overall frustoconical shape of the jaw assembly 500, meaning that the first jaw 306*a* narrows towards its first end 602 and widens towards its second end 604.

Figure 5A:
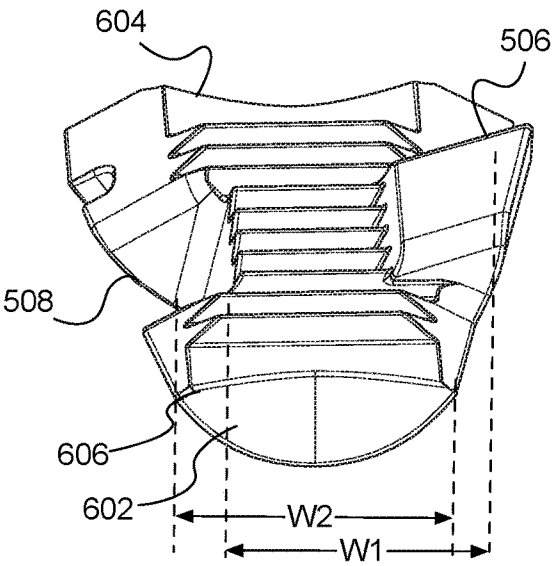
FIGS. 5*a* to 5*c* show a jaw of another jaw assembly from different angles.

The jaw 606 as shown in FIG. 5*a* is similar to the jaw 306 in FIG. 4*a* however their internal profiles are different for accommodating different sizes of mandrels as will be described below. The radius of curvature of the outer surface of the jaw 606 is the same as the jaw 306 in FIG. 4*a*. A second jaw assembly can thus be formed by interlocking three jaws 606 in a similar manner to that shown in FIG. 3*a*.

Figure 4C:
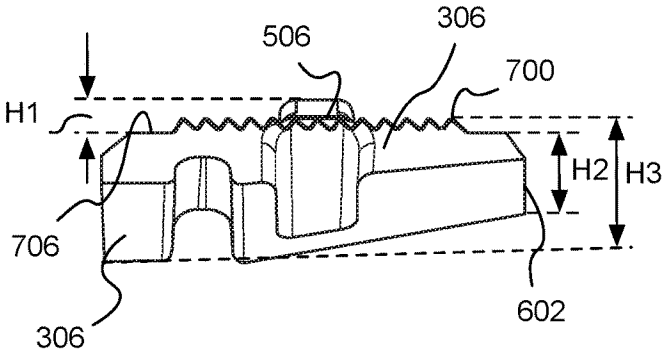
Figure 4B:
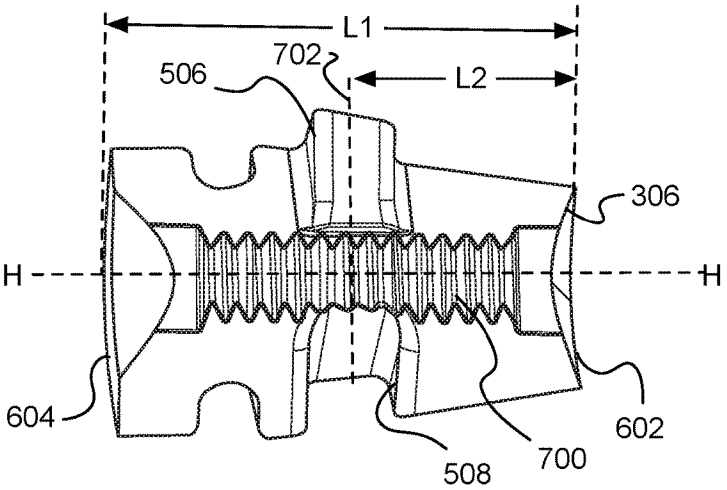

FIGS. 4*b* and 4*c* show a plan and side view of the jaw 306 of the first jaw assembly 500.

Figure 5C:
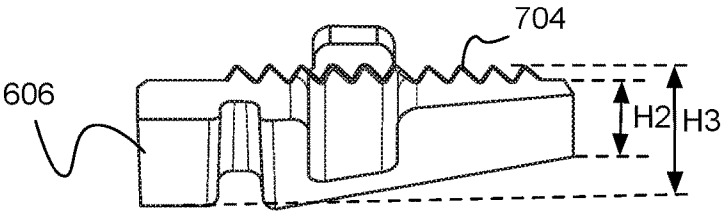
Figure 5B:
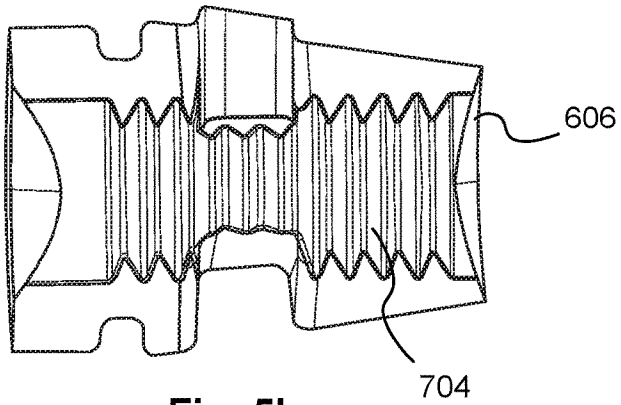

FIGS. 5*b* and 5*c* show a plan and side view of the jaw 606 of the second jaw assembly.

As will be described in more detail later on the first jaw assembly 500 formed of jaws 306 of the kind shown in FIGS. 4*a* to 4*c* is configured to grip thinner blind rivet mandrels compared to a jaw assembly formed of jaws 606 of the kind shown in FIGS. 5*a* to 5*c*. A user can swap the first jaw assembly 500 for the second jaw assembly as required because the outer profiles of the first and second jaw assemblies are the same, however, their inner profiles are configured to grip mandrels of different sizes. It will thus be appreciated that the different jaw assemblies can have different internal profiles configured for a specific purpose, such as to grip a particular type or size of rivet, however the outer profile of each jaw assembly for use with the tool 100 must be of a size and shape capable of cooperating with the conical inner surface 310 of the pull-back hull 304, the ramped front surface 316 of the separator sleeve 312 and the annular ramped surface 402 of the nose piece 320 as heretofore described.

Referring to FIGS. 4*a* to 4*c* variations of the projections 506 and recesses 508 will be discussed further. Providing the recess 508 with a width that is too large can weaken the jaws 306 compared to a version of such jaws where the recess 508 is narrower. An optional example of a jaw 306, illustrated in FIG. 4*a*, has a width W1 between the bottom surface 520 of the recess 508 and the front-side of the outer edge of projection 506 which is approximately the same as the width W2 between opposite sides of the jaw 306 across the first end 602. If W1 was much narrower relative to W2 this would provide a weak point between the first and second ends 602, 604 meaning the jaw 306 would be more likely to crack in use. Manufacturers are free to select a ratio of W1/W2 which achieves a workable set of jaws based on the strength of the material available to form the jaws and the minimum failure rate which is considered acceptable to them.

The location of the projection 506 and recess 508 on a jaw 306 can also be varied though positioning the recess 508 too close to the first end 602 can weaken the jaw 306 and thereby the entire jaw assembly 500. To address this the recess 508 is positioned midway between the first jaw end 602 and the second jaw end 604 as illustrated in FIG. 4*b*. In other words, a centre point 702 of the projection 506 and the recess 508 of a jaw 306 are located at a distance L2 from the first jaw end 602, wherein L2 is half of the distance L1 between the first jaw end 602 and the second jaw end 604. Both the interlocking portion 506 and the reciprocal recess 508 are located at the same distance from the first jaw end 602 and the second jaw end 604 so that identical jaws 306*a*, 306*b*, 306*c* can cooperate to form the jaw assembly 500 in FIG. 3*a*.

Looking at FIG. 4*c* the projection 506 of the jaws 306 of the first jaw assembly 500 projects above an internal surface 706 of the jaw 306 by a height H1. The height H1 is greater than the maximum separation X1 of the jaws 306 (see FIG. 3*b*) when a mandrel of the type intended to be used in connection with the jaw assembly 500 is received between the jaws 306. This means that the projections 506 of the jaw assembly 500 can always be in contact with the walls 514, 516 of the recesses 508 for limiting axial movement of the jaws 306 relative to each other in use.

With reference to FIGS. 4*a* and 4*b* the jaws 306 comprise a plurality of gripping teeth 700 for improving the grip on a mandrel of a blind rivet in use. The gripping teeth 700 extend at least along a portion of the jaw 306 between the first end 602 and the second end 604. The height of the teeth 700 and the spacing between the teeth 700 can be adapted. For example, the spacing, height and width of the teeth 700 on the jaws 306 of the first jaw assembly 500 are smaller than the spacing, height and width of the teeth 700 on the jaw 606 of the other jaw assembly (compare FIGS. 4*c* and 5*c*).

FIGS. 4*c* and 5*c* show some dimensions of the jaw 306 and the jaw 606. In the jaw 306 a first jaw height H2 is shown between the inner surface and the outer surface of the jaw 306 at the first end 602 and a second jaw height H3 is shown between the upper edge of the teeth 700 and the outer surface of the thickest part of the jaw 306. In some examples the jaw 306 comprises a first jaw height H2=2.3 mm and a second jaw height H3=4.55 mm. Alternatively in the jaw 606 the first jaw height H2=2.0 mm and the second jaw height H3=4.12 mm. This means that the first jaw assembly 500 comprising three jaws 306 can receive blind rivets having a maximum diameter of 4.8 mm. Alternatively, a jaw assembly comprising three jaws 606 can receive blind rivets having a maximum diameter of 6.4 mm.

It will be appreciated that whilst various aspects and embodiments have heretofore been described the scope of the present invention is not limited thereto and instead extends to encompass all arrangements, and modifications and alterations thereto, which fall within the spirit and scope of the appended claims.

The tool 100 in the drawings comprises a battery 104. In some examples the battery 104 is removable or alternatively the battery 104 is integral to the tool 100. In some embodiments the tool 100 comprises other power sources e.g. a mains power supply.

The heretofore described jaw assembly 500 and variants thereof need not necessarily be used in an electrically powered blind rivet setting tool but could be used in blind rivet setting tools of other varieties such as pneumatic blind rivet setting tools, hydraulic blind rivet setting tools or manually powered tools for example.

The heretofore described jaw assembly 500 and variants thereof need not necessarily be used exclusively in blind rivet setting tools but may be used in other rivet setting tools in which a set of jaws is caused by a pull-back hull to pull on the rivet to be set.

As shown in FIG. 1 the driving sleeve 126 and input sleeve 128 are fixed to each other due to a friction fit arrangement. Alternatively, the driving sleeve 126 and input sleeve 128 can be fixed via an interlocking arrangement such as a spline fit arrangement or other male and female interlocking-type arrangement.

The o-ring 502 can be replaced with any other retainer suitable for urging the jaws of a jaw assembly radially towards each other such as a c-clip, a circlip, an e clip, a snap ring or spring fastener.

It will be appreciated that a retainer such as an o-ring 502 is not essential and that a jaw assembly can be used which does not have a retainer, however, it will be affected by the disadvantage that when the jaw assembly is removed from the tool 100 the jaws fall apart from each other, meaning that it is more difficult for a user to insert a jaw assembly which does not have a retainer such as an o-ring 502 into the blind rivet setting tool 100.

The o-ring 502 is made from an elastic material such as rubber but this is not exclusive and the o-ring 502 can alternatively be made of other flexible materials such as polyurethane, PTFE, ethylene propylene rubber, neoprene, nitrile, or silicone.

The shape of the heretofore described projections 506 and recesses 508 are not limited to those shown in the drawings. More generally a first side of each jaw in a jaw assembly defines a male part of a two-part interlocking mechanism and the opposite side of each such jaw defines a female part of the two-part interlocking mechanism; whereby said male and female parts of adjacent jaws interlock with each other to enable radial movement of the jaws relative to each other while restricting axial movement of the jaws relative to each other.

In some embodiments each jaw may have multiple features on either side of the jaw which interlock with corresponding features of an adjacent jaw. For example, a first side of each jaw in a jaw assembly may define at least one male part of a two-part interlocking mechanism and the opposite side of each such jaw defines at least one female part of the two-part interlocking mechanism; whereby said male and female parts of adjacent jaws interlock with each other to enable radial movement of the jaws relative to each other while restricting axial movement of the jaws relative to each other.

In some embodiments each jaw may have at least one male and at least one female feature on either side of the jaw which interlock with corresponding features of an adjacent jaw. For example a first side of each jaw in a jaw assembly may define at least one male part and a least one female part of a two-part interlocking mechanism and the opposite side of each such jaw defines at least one female part and at least one male part of the two-part interlocking mechanism; whereby said male and female parts of adjacent jaws interlock with each other to enable radial movement of the jaws relative to each other while restricting axial movement of the jaws relative to each other.

As shown in FIG. 4*b* the projection 506 and the recess 508 of a jaw 306 are located midway between the first jaw end 602 and a second jaw end 604 along a jaw axis H-H. However, in other examples, the projection 506 and the recess 508 can be located at any position along the jaw 306 provided that the projection 506 and the recess 508 are aligned with each other. For example, the projection 506 and the recess 508 can be located closer to the first jaw end 602 or the second jaw end 604 compared to the embodiment shown in FIG. 4*b*.

Although the illustrated jaw assembly embodiments have three jaws it will be appreciated that this is not limiting and that a jaw assembly may have fewer or more than three jaws, wherein a person skilled in the art will understand how to modify the shape and dimensions of the illustrated jaws in order to form a jaw assembly from fewer or more than three jaws. In some embodiments a jaw assembly may have two jaws and in other embodiments a jaw assembly may have four or more jaws.

In a jaw assembly embodiment having two jaws a first jaw may have two male parts of a two-part engagement mechanism, whereas the second jaw may have two female parts of a two-part engagement mechanism. For example, the first jaw may be substantially U-shaped and have a projection at each end facing in a direction towards the second jaw. Similarly, the second jaw may be substantially U-shaped and have a recess at each end facing in a direction towards the first jaw. The projections mate with the recesses for guiding radial movement of the first and second jaws while restricting axial movement of the first and second jaws relative to each other.

What is claimed is:

1. A jaw assembly for a rivet setting tool, the jaw assembly comprising a plurality of jaws, each jaw of the plurality of jaws defining interlocking portions, each interlocking portion interlocking with at least one other adjacent jaw of the plurality of jaws and wherein adjacent jaws interlock with each other for enabling radial movement of the jaws toward a central longitudinal axis and relative to each other while restricting axial movement of the jaws relative to each other, the assembly forming a conical outer surface.

2. The jaw assembly of claim 1 wherein each said jaw defines at least one male interlocking portion of a said interlocking portions and a correspondingly located at least one female interlocking portion of another of said interlocking portions.

3. The jaw assembly of claim 1, wherein each said jaw defines at least one male part and at least one female part of a said interlocking mechanism and an oppositely located at least one female part and at least one male part of another said interlocking mechanism.

4. The jaw assembly of claim 2, wherein the at least one male part of a said interlocking mechanism is a projection and the at least one female part of a said interlocking mechanism is a recess.

5. The jaw assembly of claim 4 wherein each of the jaws has a single projection and a single recess.

6. The jaw assembly of claim 5 wherein the projection and the recess of each said jaw is positioned mid-way between first and second ends of the jaws.

7. The jaw assembly of claim 4, wherein each of the jaws comprises gripping teeth for gripping a mandrel of a blind rivet in use wherein a width of the gripping teeth is narrower between the projections and recesses.

8. The jaw assembly of claim 2, wherein each jaw includes a plurality of teeth disposed on a radially inner portion of the jaw, the plurality of teeth ending extending in a direction of the central longitudinally.

9. The jaw assembly of claim 8, wherein the plurality of teeth extend along at least one of the interlocking portions.

10. The jaw assembly of claim 8, wherein each tooth of the plurality of teeth extends transverse to the central longitudinal axis.

11. The jaw assembly of claim 1, wherein the jaw assembly comprises an elastic retainer for biasing the jaws radially towards each other.

12. The jaw assembly of claim 11, wherein the retainer is an o-ring, a c-clip, an elastic ring or a spring fastener.

13. The jaw assembly of claims 11, wherein each said jaw comprises a groove configured to receive the retainer.

14. A rivet setting tool comprising the jaw assembly of claim 1, and wherein the jaw assembly includes at least 3 jaws.

15. The tool of claim 14, wherein the tool is a blind rivet setting tool.

16. The jaw assembly of claim 1 wherein the jaw assembly has a first jaw and a second jaw and wherein the first jaw is provided with a first male part of a first interlocking mechanism and an oppositely located male part of a second interlocking mechanism whereas the second jaw is provided with a female part of the first interlocking mechanism and an oppositely located female part of the second interlocking mechanism.

17. The jaw assembly of 9, wherein the male parts of the interlocking mechanisms are projections and the female parts of the interlocking mechanisms are recesses.

18. The jaw assembly of claim 1, wherein the jaw assembly comprises a first jaw, a second jaw and a third jaw which are identically shaped.

19. The jaw assembly of claim 1, wherein each jaw includes a ramped outer surface for cooperating with a ramped inner surface of a pull-back hull.

* * * * *